United States Patent [19]

Polit

[11] Patent Number: 4,620,807

[45] Date of Patent: Nov. 4, 1986

[54] ARTICLE TRANSPORT FOR PRINTERS

[75] Inventor: Neil A. Polit, Crystal Lake, Ill.

[73] Assignee: Xerox Corporation, Stamford, Conn.

[21] Appl. No.: 779,327

[22] Filed: Sep. 23, 1985

[51] Int. Cl.[4] ..... B41J 11/20

[52] U.S. Cl. ..... 400/56; 400/58; 400/27; 400/649; 101/232; 101/407 BP; 271/274

[58] Field of Search ..... 400/23, 27, 55, 56, 400/57, 58, 59, 60, 352, 355, 356, 649, 656, 264; 101/232, 407 BP; 198/592; 271/34, 273, 274

[56] References Cited

U.S. PATENT DOCUMENTS

| | | | |
|---|---|---|---|
| 3,618,934 | 11/1971 | Germuska | 271/274 |
| 3,912,068 | 10/1975 | Kwan et al. | 400/56 |
| 3,942,785 | 3/1976 | Stange | 271/274 |
| 3,999,749 | 12/1976 | Zambolin et al. | 271/274 |
| 4,184,780 | 1/1980 | Kurihara et al. | 400/56 |

FOREIGN PATENT DOCUMENTS

| | | | |
|---|---|---|---|
| 2844150 | 4/1979 | Fed. Rep. of Germany | 400/58 |
| 55-111281 | 8/1980 | Japan | 400/55 |
| 57-163588 | 10/1982 | Japan . | |
| 59-214675 | 12/1984 | Japan | 400/56 |
| 2076341 | 12/1981 | United Kingdom . | |
| 2077194 | 12/1981 | United Kingdom . | |
| 1014770 | 4/1983 | U.S.S.R. | 400/55 |

*Primary Examiner*—Edgar S. Burr
*Assistant Examiner*—David A. Wiecking
*Attorney, Agent, or Firm*—Frederick E. McMullen

[57] ABSTRACT

A self-leveling tranpsort for addressing envelopes in cooperation with a printer having a first link on each side of the transport, with transport drive and idler roller shafts journaled at the opposite ends, an endless transport belt stretched across the drive and idler rollers, a second link pivotally attached to each first link through the idler roller shaft, the second links being pivotally attached to the printer frame at the second links other end, a third cross link pivotally attached to each second link between the link ends, the second links having a slide block with oversized aperture at the opposite end through which the drive roller shaft fits, the slide blocks being slidable vertically up and down with springs to bias the slide blocks and the transport upwardly so that when the thickness of the articles increase, the first, second, and third links respond to draw the transport down while retaining the transport level.

2 Claims, 3 Drawing Figures

5
10
12
13
14
15a 15b
15n
16
18
20
21
22
24
25
30
31
32
33
35
36
37
39
40
41
44
50
51
53
60
62
63
64
67
67'
68
68'
70
71

59
54
13
14
55
56
58
51'
12
40'
71
70
67
67'
24
20
39
37'
30
58
36'
51
57
21
50
53
5
40
44
25
22
41
68'
36
68
37

ARTICLE TRANSPORT FOR PRINTERS

The invention relates to a transport for bringing articles to be addressed to a printer, and more particularly, to an improved self-adjusting leveling article transport which automatically adjusts to changes in article thickness so as to maintain the gap between the article and the printing head of the printer substantially constant without tilting or offsetting of the transport.

When printing addresses on articles such as envelopes, newspapers, and the like, it is normally essential to maintain a predetermined operating gap between the print head of the printing device and the article being addressed. This is especially true in the case of a printer such as a dot matrix printer using movable printing elements such as pins or wires. If the gap is too small, the inked ribbon may offset ink onto the article. When this happens, the article is usually damaged or destroyed and a jam created. On the other hand, if the gap is allowed to become too large, the article may be beyond the effective stroke of the print head pins or wires with resultant skipping or omission of some or all of the address information.

It will be understood that any change in the thickness of the articles being addressed will alter the operating gap between print head and article. One method of accommodating this is to stop the printer and manually reset the gap to the desired size for the particular article thickness being processed. Following this, the printer is restarted. However, the delay attending this is costly and uneconomical, particularly where high speed article addressing is desired and the articles to be addressed change thickness frequency from batch to batch and even within batches.

The invention seeks to correct the above by providing an article transport for bringing articles to be addressed into operative relation with the print head of a printer which accommodates changes in article thickness while remaining level comprising, in combination: a first pair of links forming opposite sides of the transport; drive and idler shafts journaled therebetween adjacent each end of the links, the drive and idler shafts each supporting at least one roller; an endless article transport belt stretched about the rollers; a second pair of links, one of the second links being rotatably journaled with one of the first links adjacent one end through one of the drive and idler shafts, the second links extending downwardly with the opposite end pivotally attached to the printer whereby to form a first pivotal support for said transport in the printer; a third pair of links, one of the third links being pivotally attached by one end with each one of the second links, the opposite ends of the third links being enlarged and receiving the other of the drive and idler shafts therethrough whereby the third links are pivotally and slidably attached to the opposite end of the first links; a slide block supporting the opposite ends of the third links on the printer for vertical up and down movement whereby to form a vertically displaceable second support for the transport in the printer; and means biasing the opposite ends of the third links upwardly to cause the belt in cooperation with an adjoining roll to form a resilient nip through which the articles pass; whereby on entry of an article having a different thickness into the nip, the nip changes size while the first, second, and third links cooperate to change the height of the transport in response to the change in nip size while maintaining the transport level.

IN THE DRAWINGS

Figure 1:
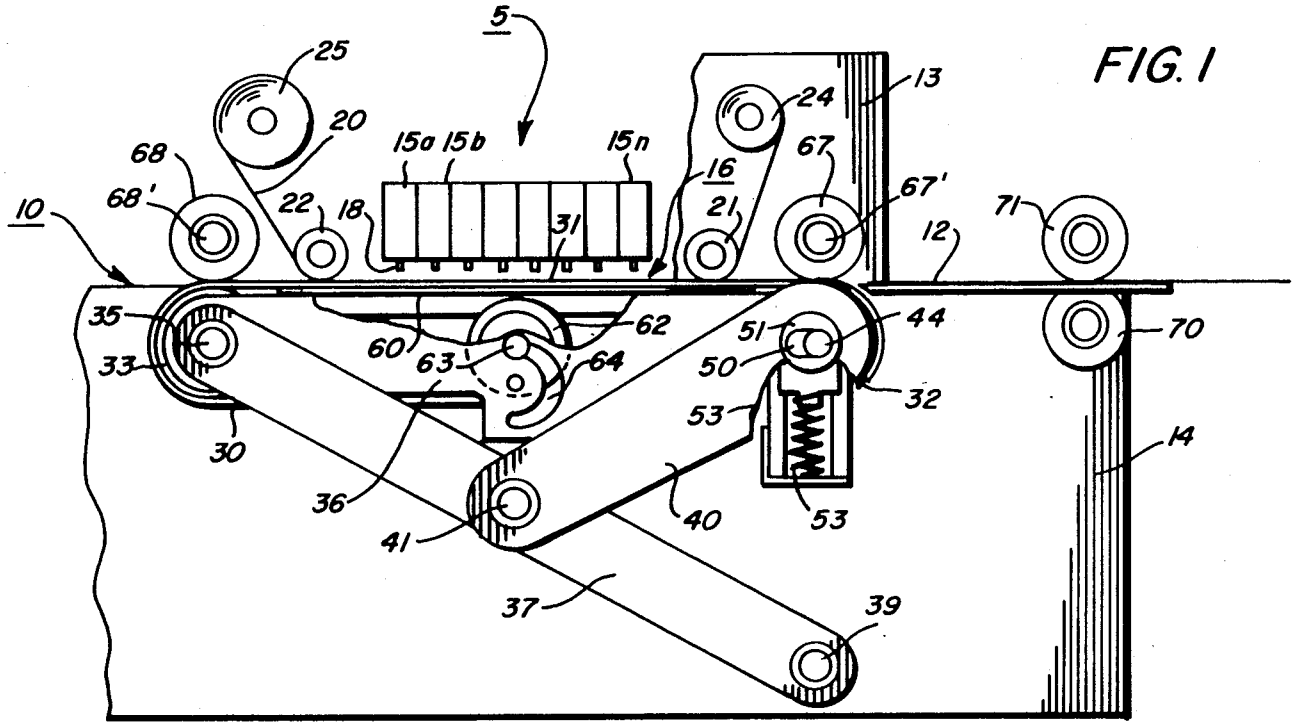
FIG. 1 is a side view of the article transport of the present invention illustrating details of the transport and the related dot matrix printer, with the transport being in the maximum up position for addressing envelopes of minimum thickness.
Figure 2:
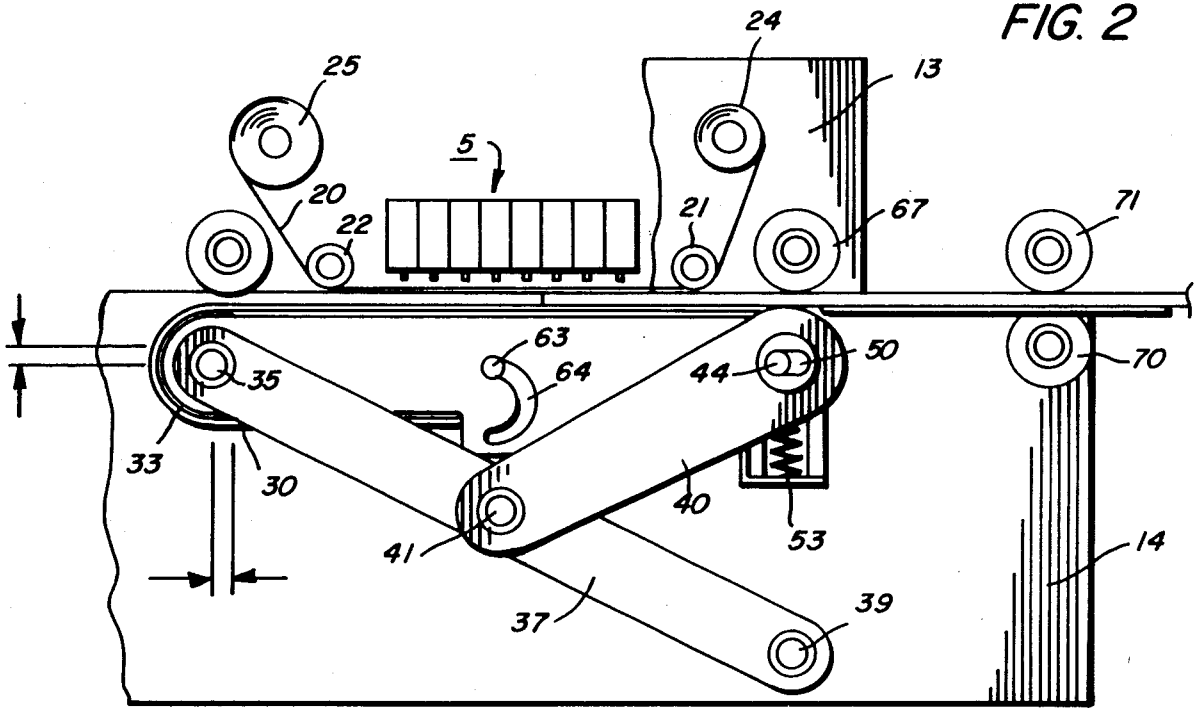
FIG. 2 is a side view of the article transport of the present invention as in FIG. 1 but with the transport in the maximum down position for addressing envelopes of maximum thickness.
Figure 3:
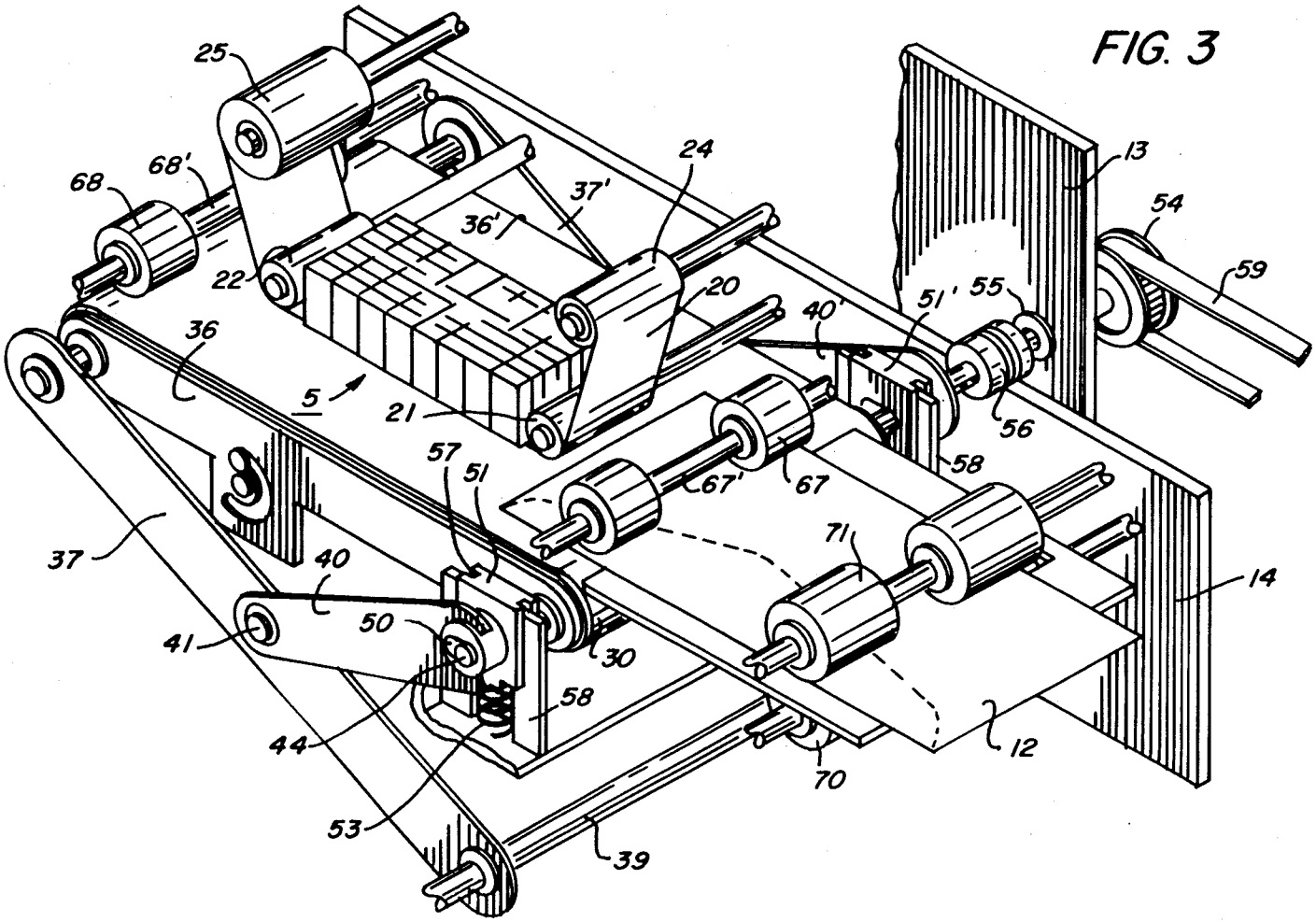
FIG. 3 is an isometric view of the article transport shown in FIGS. 1 and 2.

Referring to FIGS. 1–3 of the drawings, there is shown a dot matrix type printer 5 incorporating the self-leveling transport platen, designated generally by the numeral 10, of the present invention. Printer 5 serves to print address information on mailing articles shown here in the form of envelopes 12. Envelopes 12 are supplied to printer 5 from a suitable source such as an envelope supply tray (not shown) with the finished envelopes being output from printer 5 to a suitable output device such as a takeaway conveyor (not shown).

Printer 5 has a suitable frame 13 to which a plurality of dot matrix print heads 15*a*, 15*b*, . . . 15*n* are supported at a printing station 16. Each print head 15*a*, 15*b* . . . 15*n* has a plurality of reciprocal strikers, referred to as print wires 18, arranged in a linear array. Print heads 15*a*, 15*b* . . . 15*n* are oriented so that the arrays of print wires 18, which are parallel to one another, extend in a direction transverse to the direction of movement of envelopes 12 through printing station 16. An ink source in the form of inking ribbon 20 is spacedly disposed below print heads 15*a*, 15*b* . . . 15*n*, ribbon 20 being stretched between opposing guide rollers 21, 22 at the inlet and exit to printing station 16. Ribbon 20, which is supplied from a supply reel 24, passes over guide roller 21 and through printing station 16 to guide rollers 22 and from roller 22 to take up reel 25.

Transport platen 10 has an endless belt 30 trained about drive and idler rollers 32, 33 respectively so that there is provided a flat belt run 31 oposite print heads 15*a*, 15*b* . . . 15*n* and spaced below inking ribbon 20. As will appear, platen 10 provides in addition to transporting the envelopes being addressed through printing station 16, a support for the envelopes 12 during address printing. To accommodate the various thickness envelopes that may be encountered while at the same time assuring that the envelope being printed is supported within the effective stroke of printing wires 18, transport platen 10 is mounted so as to move up and down while at the same time remaining level.

Idler roller 33 of transport platen 10 is mounted on a shaft 35 rotatably journaled in links 36, 37 on one side of platen 10 and links 36', 37' on the other side. Links 36, 36', which are substantially horizontal, cooperate to form the opposing sides of transport 30. Links 37, 37', which project downwardly, are pivotally attached to sides 14 of frame 13 by pivot pin 39.

Cross links 40, 40' are pivotally attached by pivot pins 41 to links 37, 37' respectively, adjacent the midpoint of links 37, 37'. The opposite ends of links 36, 36' have shaft 44 of belt driving roller 32 rotatably journaled therein with shaft 44 passing through an elongated opening 50 in slide blocks 51, 51'. Slide blocks 51, 51' provide a bearing surface for supporting the ends of links 40, 40'. The opposite sides of blocks 51, 51' have a slot-like track 57 which slidably interlocks with the edges of members 58 in sides 14 so that blocks 51, 51' are supported for vertical up and down movement. Springs 53 bias slide blocks 51, 51' upwardly.

A drive pulley 54, which is journaled by bushing 55 in frame 13, is connected by a flexible coupling 56 to shaft 44. Pulley 54 is coupled by a drive belt 59 to a suitable transport drive motor (not shown). Flexible coupling 56 accommodates up and down movement of shaft 44 with transport platen 10 while maintaining drive pulley 54 fixed against displacement.

Transport platen 10 has a flat plate-like belt support 60 located below belt run 31 for supporting the envelopes during printing and positioning the envelopes in the required spaced relation with print wires 18 of print heads 15*a*, 15*b*... 15*n*. Support 60 is secured to links 36, 36'.

A tensioning roller 62 is disposed within the transport belt, roll 62 being rotatably journaled on a shaft 63 carried by links 36, 36'. To provide tensioning movement of roller 62, a semi-circular cutout 64 is provided in links 36, 36' to permit tensioning roller 62 to pivot, thereby controlling the pressure against transport belt 30 and belt tension. Suitable locking means (not shown) are provided for locking the tensioning roller shaft 63 in selected position. A pair of belt transport idler rollers 67, 68 are provided opposite belt support rollers 32, 33 respectively at the inlet and exit to printing station 15, rollers 67, 68 cooperating with transport belt 30 to form nips between which the envelopes 12 pass. Support shafts 67', 68' of rollers 67, 68, respectively are rotatably journaled in frame 13. An envelope feed roll pair 70, 71 feeds the envelopes to be printed from the envelope supply (not shown) to transport platen 10.

OPERATION

In operation of the self-leveling transport platen 10, and presuming that there occurs an envelope 12 of increased thickness, the thicker envelope forces the nip formed between idler roller 67 and transport belt 30 further apart. Since shaft 67' of idler roller 67 is fixed against displacement, the increased nip separation is taken up by displacement of slide blocks 51, 51' against the bias of springs 53. This is through interengagement of drive roller 32, roller support shaft 44, and slide blocks 51, 51' with one another. Downward movement of slide blocks 51, 51' in turn forces the end of links 40, 40' downwardly, causing links 40, 40' to pivot about pins 41 and move links 37, 37' both outwardly (i.e. toward the left in FIG. 1) and downwardly about pivot pins 39. Since both roller support shafts 35, 44 are being forced downwardly at the same time and by the same amount, links 36, 36' are carried downwardly through roller support shafts 35, 44. As a result, the entire transport platen 10 is moved downwardly on an even keel with belt run 31 level.

The outward component of movement (i.e. to the left in FIG. 1) imparted to links 36, 36' by the downwardly and outwardly swinging movement of links 37, 37' is accommodated by the elongated opening 50 in slide blocks 51 which permits roller support shaft 44 to move outwardly as shown particularly in FIG. 2.

While transport platen 10 is described and shown with a dot matrix printer 5, other applications for transport platen 10 may be envisioned, as for example, with an ink jet printer having a small depth of field for focus.

While the invention has been described with reference to the structure disclosed, it is not confined to the details set forth, but is intended to cover such modifications or changes as may come within the scope of the following claims.

I claim:

1. An article transport for bringing articles to be addressed into operative relation with the print head of a printer which accommodates changes in article thickness while remaining level comprising, in combination:

(a) a first pair of links forming opposite sides of said transport;

(b) drive and idler shafts journaled between said links adjacent each end of said links, said drive and idler shafts each supporting at least one roller;

(c) an endless article transport belt stretched about said rollers;

(d) a second link rotatably journaled with each of said first links adjacent one end through one of said drive and idler shafts, said second links extending downwardly with the opposite end pivotally attached to said printer whereby to form a first pivotal support for said transport in said printer;

(e) a third link attached by one end with each one of said second links, the opposite ends of said third links being enlarged and receiving the other of said drive and idler shafts therethrough whereby said third links are pivotally attached to the opposite end of said first links;

(f) slide blocks supporting the opposite ends of said third links on said printer for vertical up and down movement whereby to form a vertically displaceable second support for said transport in said printer; and (g) spring means biasing said slide blocks and the opposite ends of said third links upwardly to cause said belt in cooperation with an adjoining roll to form a resilient nip through which said articles pass;

whereby on entry of an article having a different thickness into said nip, the nip changes size while said first, second, and third links cooperate to change the height of said transport in response to the change in nip size while maintaining said transport level.

2. A printing apparatus including reciprocably movable printing means for printing addresses on individual media, an article transport for bringing media to be addressed into printing relation with said printing means while forming a platen opposite said printing means for supporting the media during printing by said printing means, in which said article transport comprises in combination:

(a) a pair of side links forming the opposing sides of said transport and extending in the direction of media movement;

(b) a first shaft journaled for rotation between said side links adjacent one end of said side link;

(c) first belt supporting roller means on said first shaft;

(d) a second shaft journaled for rotation between said side links adjacent the other end of said side links;

(e) second belt supporting roller means on said second shaft;

(f) an endless media transport belt around said first and second belt supporting roller means;

(g) roller means cooperating with said belt to form a nip between which said media passes while being transported by said belt;

(h) a downwardly extending support link pivotally attached to said side links through said second shaft;

(i) first pivot means for pivotally attaching the opposite end of each of said support links to said printer;

(j) a pair of cross links;

(k) second pivot means for pivotally attaching each of said support links to one of said cross links at one end of said cross links;

(l) the opposite end of each of said cross links being rotatably journaled in a slide block, said slide blocks having an enlarged aperture therethrough for receiving said first shaft to thereby couple said side links with said cross links through said first shaft;

(m) track means for slidably supporting said slide blocks for vertical up and down movement; and (n) bias means biasing said slide blocks upwardly whereby to bias said nip through said slide blocks, first shaft, first belt supporting roller means and belt toward a closed position so that on a change in the thickness of said media, the media entering said nip forces said transport belt, first belt supporting means, first shaft, and slide blocks downwardly in said tracks means against said bias means so that said cross links work through said second pivot means to pivot said support links through said first pivot means with resultant combined pivoting and lateral movement of said side links so that said transport moves uniformly downwardly while remaining level in support of the media being addressed.

* * * * *